US005320157A

United States Patent [19]

Siak et al.

[11] Patent Number: 5,320,157

[45] Date of Patent: Jun. 14, 1994

[54] EXPENDABLE CORE FOR CASTING PROCESSES

[75] Inventors: June-Sang Siak, Troy; Richard M. Schreck, Bloomfield Hills; Kush K. Shah, Saginaw, all of Mich.

[73] Assignee: General Motors Corporation, Detroit, Mich.

[21] Appl. No.: 10,025

[22] Filed: Jan. 28, 1993

[51] Int. Cl.[5] ..... B22C 9/10; B22C 9/12; B22C 1/20

[52] U.S. Cl. ..... 164/12; 164/14; 164/132; 164/369; 164/522; 164/525; 164/528; 106/38.4; 106/38.51; 106/125; 106/137

[58] Field of Search ..... 106/38.4, 38.51, 125, 106/137; 164/12, 14, 132, 369, 522, 525, 528

[56] References Cited

U.S. PATENT DOCUMENTS

| | | | |
|---|---|---|---|
| 2,206,369 | 7/1940 | Salzberg | 106/38.4 |
| 2,684,344 | 7/1954 | Phillips | 260/17.3 |
| 2,974,048 | 3/1961 | Sietsema | 106/38.5 |
| 2,974,050 | 3/1961 | Barlow | 106/38.5 |
| 3,166,808 | 1/1965 | Moore | 106/38.51 |
| 3,212,145 | 10/1965 | Green | 106/38.51 |
| 3,285,756 | 11/1966 | Morén | 106/38.4 |
| 3,523,094 | 8/1970 | Roberts et al. | 260/17.2 |
| 4,098,859 | 7/1978 | Cummisford et al. | 264/122 |
| 4,500,453 | 2/1985 | Shank | 106/125 |
| 4,711,669 | 12/1987 | Paul et al. | 106/38.51 |
| 4,814,012 | 3/1989 | Paul et al. | 106/38.51 |

OTHER PUBLICATIONS

Avallone et al., "Marks' Standard Handbook for Mechanical Engineers"; 9th Edition (1987) p. 13-6.

*Primary Examiner*—Paul Lieberman
*Assistant Examiner*—Margaret Einsmann
*Attorney, Agent, or Firm*—George A. Grove

[57] ABSTRACT

A method is provided for forming a sand core which is suitable for use in casting processes, and in particular squeeze casting processes, to form internal features and intricate external features of a cast article. The core forming method involves the use of a single-component gelatin binder whose degradation at elevated temperatures is catalyzed by additions of a ferric compound. The gelating binder is a mixture of proteins derived from amino acids such as glycine, alanine, L-glutamic acid, L-aspartic acid, and/or small percentages of others, such that the gelatin binder is water soluble and therefore easily eliminated from the core sand at the end of the casting process. Due in particular to the presence of the ferric compound, the gelatin binder readily degrades at low temperatures, such as those associated with aluminum casting processes, such that the core degrades sufficiently to permit the sand to freely flow from the cast article without the need for core removal operations. Finally, the gelatin-based binder is nontoxic, such that its elimination from the sand to reclaim the sand for reuse does not pose an environmental hazard.

19 Claims, 2 Drawing Sheets

EXPENDABLE CORE FOR CASTING PROCESSES

BACKGROUND OF THE INVENTION

The present invention generally relates to binders used with sand casting processes and operations. More particularly, this invention relates to an improved binder for cores of the type which are placed in a mold cavity to form the interior surfaces of a casting, wherein the binder is characterized as imparting improved hot strength to the core while also being composed primarily of gelatin so as to be water soluble and nontoxic, and therefore capable of being readily and economically removed from the sand after the casting process, so as to facilitate the recycling of the sand for continued use without imposing an environmental hazard.

Metal casting is a widely practiced process for making ferrous and nonferrous articles which involves providing a mold cavity and pouring molten metal into the cavity so as to form a cast article. Where an intricate and complex casting is required, a core molding process is employed which entails placing a shaped and somewhat rigid form or core within the mold cavity to form particular features of the casting, such as interior surfaces of cavities and intricate features in the casting's exterior surface. One or more cores can be readily used in a casting process, either as assembled units or individually in separate areas of the mold cavity. Cores can be used in both sand-casting and permanent-mold casting methods and are typically formed of sand.

The shape of the core is maintained by the use of binders which adhere the sand particles together. The type of binder employed depends upon such factors as the green strength required of the core for handling, the anticipated interval between the time the core is formed and used, possible degradation by moisture or other atmospheric conditions, and the hot strength required of the core during the molding operation for maintenance of the core geometry until the casting has sufficiently solidified.

Hot strength is a particularly important property for cores used in squeeze casting processes, wherein high pressure is typically applied by a hydraulic press and maintained on the molten metal as it solidifies. Squeeze casting is a highly desirable technique for forming castings because it can be used for a variety of ferrous and nonferrous alloys to produce pore-free, fine-grain castings with excellent mechanical properties. Furthermore, squeeze casting is a relatively economical process and can be automated to operate at high rates of production. However, in combination with the elevated temperatures created by the molten metal, the high pressures associated with squeeze casting are particularly detrimental to the structural integrity of sand cores used within the mold cavity.

In the prior art, various types of binders are known, both organic and inorganic, for adhering the sand particles together. Linseed oil-based organic binders are widely used and contain a resin and thinner, such as high-grade kerosene, to provide good wetting and workability properties. Other known organic binders, including plastics of the urea- and phenol-formaldehyde groups, are also widely used. These organic binders generally entail a two-part polymer resin which is set during the core forming process so as to form an extremely durable core.

While plastic binders have generally performed well in iron casting operations, such binders are not readily volatilized or broken down at lower molding temperatures, such as those associated with aluminum casting operations. As a result, all or some of the core sand may not be readily removable from the casting after it has cooled. Obviously, a casting will be unusable if the core cannot be removed from the casting. Furthermore, where the core has not sufficiently degraded to allow the sand to flow freely from the casting, mechanical operations used to forcibly shake or extract the core from the casting may result in the destruction of the casting. In addition, because most current binders are thermoplastic materials, they also tend to flow or distort under the high heat and pressure of a squeeze casting operation, and therefore do not produce dimensionally accurate cavities when used in such operations.

An additional shortcoming of these conventional binders is that gases produced when such binders are volatilized are undesirable from the standpoint of causing porosity in the casting, as well as the potential environmental hazards which they may pose. Environmental hazards often persist after the casting operation when the core sand is disposed of or recycled for reuse within the foundry. Whether the binder residue is soluble in some medium or must be combusted, the process necessary to reclaim the sand will often have a harmful byproduct which cannot be returned to the environment because the binder residue within the byproduct may leach off into the ground water and cause contamination. Because such binders are not usually removable by use of a solvent, the need to burn the residue becomes a costly disadvantage which still poses an environmental hazard in the form of air pollution. Furthermore, disposal of the used core sands without clean-up is costly with current binders because the binder residues are toxic and render the sand/binder mixture a toxic waste, requiring disposal in an appropriate land fill.

As a result, binders which can be more readily extracted from the sand with less concern for their impact on the environment are generally preferred. Such binders include corn flour and dextrin, which both rely upon the hydrolysis of starch to form a colloidal product which can bind the sand particles together. However, both of these binders must often be used in conjunction with adjuncts, such as urea- or phenol-formaldehyde resins and acid catalysts, to achieve adequate green strength and/or improve its shelf life. As an example, U.S. Pat. No. 4,711,669 to Paul et al suggests mixing the reaction product of glyoxal, urea, formaldehyde, ethylene glycol, an acid catalyst and a solvent with a polyol to improve the crosslinking of the polymers and thereby improve the resistance of the core to deterioration by moisture. However, a particular disadvantage to increasing the crosslinkage of the polymers is that higher temperatures are necessary to break the bonds of the polymer structure, and therefore sufficiently degrade the binder so as to free the sand from the casting. In addition, such an adjunct-doped binder poses to some degree the same environmental hazards and economic disadvantages noted above with plastic binders.

Other alternatives known in the prior art include protein binders such as gelatin, casein and glues. These binders may generally be characterized as providing improved flowability of the sand, high binding power, rapid drying, fair resistance to moisture, and a low burn-out temperature, with only a small volume of gas being produced as the binder becomes volatilized. Protein binders also have a crystalline structure and therefore do not have a transition temperature for melting as do thermoplastics. As a result, protein binders do not soften when heated, but hold their crystalline structural shape until they begin to decompose by oxidation. In addition, disposal of protein binders does not pose an environmental hazard in that such binders readily decompose to a nontoxic form. However, the nature of the green strength of cores made with protein binders and their slow breakdown by oxidation generally hinder the ability of protein binders to be tailored to a particular casting process, in view of such factors as temperature, pressure and casting size.

Thus, it would be desirable to provide a core sand binder which is relatively economical to use and provides adequate structural strength to the core and, in particular, sufficient hot strength to withstand the high pressures associated with squeeze casting processes. In addition, it would be desirable that such a binder be readily and controllably degraded at elevated temperatures and easily washed from the sand, so as to permit the core sand to be recycled within a foundry operation or returned to the environment without posing an adverse environmental impact. Moreover, it would be particularly desirable if such a binder would have the above characteristics even when used with relatively low temperature casting operations, such as that associated with casting aluminum alloys.

SUMMARY OF THE INVENTION

It is an object of this invention to provide a binder and a method for forming sand cores with such a binder which are suitable for use in core-molding casting processes wherein the preferred binder is composed primarily of gelatin with suitable additions of an iron compound.

It is a further object of this invention that such a binder and the method for its use produce sufficient green and hot strength in the core so as to permit ordinary handling procedures within a foundry environment and so as to withstand the high pressures associated with squeeze casting processes.

It is still a further object of this invention that such a binder be characterized as being nonflammable and nontoxic and also capable of being readily and controllably degraded for removal from the casting, even when casting temperatures are relatively low, such as when casting aluminum alloys.

In accordance with a preferred embodiment of this invention, these and other objects and advantages are accomplished as follows.

According to the present invention, there is provided a sand core binder and a method for forming cores with such a binder wherein the cores are characterized as exhibiting sufficient structural strength at room temperature for handling, as well as at elevated temperatures for use in a variety of casting processes, particularly squeeze casting processes. In addition, the binder is characterized as being water soluble, nontoxic and readily and controllably broken down at aluminum casting temperatures such that the core sand may be readily removed and recycled or returned to the environment without posing an environmental hazard.

The preferred binder is a suitable mixture of gelatin and a small amount of a metal compound to facilitate binder decomposition. The gelatin, or the gelatin-like equivalent, is a conventional, commerically available mixture of complex polypeptides comprising amino acids including glycine, L-proline, L-alanine, L-glutamic acid, L-aspartic acid and, optionally, small percentages of other proteins. Preferably, the metal compound is an iron compound present in quantities of less than about 1 weight percent. The ratio of these components may be varied to adjust the physical characteristics of the core, such as the brittleness to toughness ratio and the curing time and temperature required of the core.

As polypeptide proteins, the above constituents are colloidal by nature and serve as a binder in the presence of water. In addition, the protein polymers are considerably less crosslinked than the aforementioned plastic polymers. As a result, significantly lower amounts of heat are required to break the bonds of the protein structure and thermally degrade the binder, so as to permit the sand to move individually and freely from the casting. Additionally, the metal compound further promotes the thermal oxidation of the binder using the available oxygen trapped within the interstitial spaces of the sand. This aspect makes the binder of the present invention particularly adaptable for use with low melting point metals, such as aluminum, though it would also be expected to work well when casting iron and other higher-temperature metals.

Because the binder is also water soluble, it can be readily washed from the cavities of the casting, and the core sand can be easily cleansed of the binder to permit its reuse or return to the environment. Even if the binder does not completely thermally degrade during the casting process, the core sand can be readily washed from the casting with water because the binder is water soluble. This aspect is a distinct advantage over non-water soluble binders known in the art which, if not sufficiently degraded during the casting process, may necessitate the scrappage of the casting if the core cannot be physically removed or the casting is damaged during efforts to remove the core.

The preferred processing and molding method of the present invention improves the strength of the core by minimizing voids in the core and removes the residual water from the core through vacuum heating operations, which are well suited for foundry operations and conditions. The process includes mixing a quantity of core sand with a predetermined amount of the binder in the form of a dry powder. A small amount of moisture is then added to adjust the total moisture content of the mixture. The mixture is then introduced into a core mold under pressure. The mixture within the core mold is then heated to a temperature and for a duration which is sufficient to cure the binder. Any remaining moisture within the core can then be removed by the application of a vacuum. Once cooled, the core can then be removed from the mold cavity for immediate use.

As an advantageous feature of the present invention, the process described above causes the binder to adhere the core sand together such that the core is characterized by a closely-packed particulate structure having structural strength which is sufficient to permit ordinary handling procedures within a foundry environment, while also having sufficient hot strength to be structurally capable of withstanding the high pressures associated with squeeze casting processes.

Another advantage of this invention is that the binder readily degrades when subjected to casting temperatures as low as those associated with aluminum casting, i.e., as low as about 675° C. In particular, the amount of the metal compound present promotes the degradation of the binder, such that the rate at which the core breaks down may be controlled. As a result, the core composition may be tailored such that the core will be completely broken down during the casting process, allowing the core sand to flow freely from the casting at the end of the casting operation and after the casting has solidified.

The binder of this invention is also water soluble, nonflammable and nontoxic, such that the binder can be easily and safely washed from the core sand with water without the binder residue posing an environmental hazard. In addition, the core sand can be readily recycled for use in a later casting operation or can be returned to the environment without posing an adverse environmental impact.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawing wherein.

DETAILED DESCRIPTION OF THE INVENTION

Figure 1:
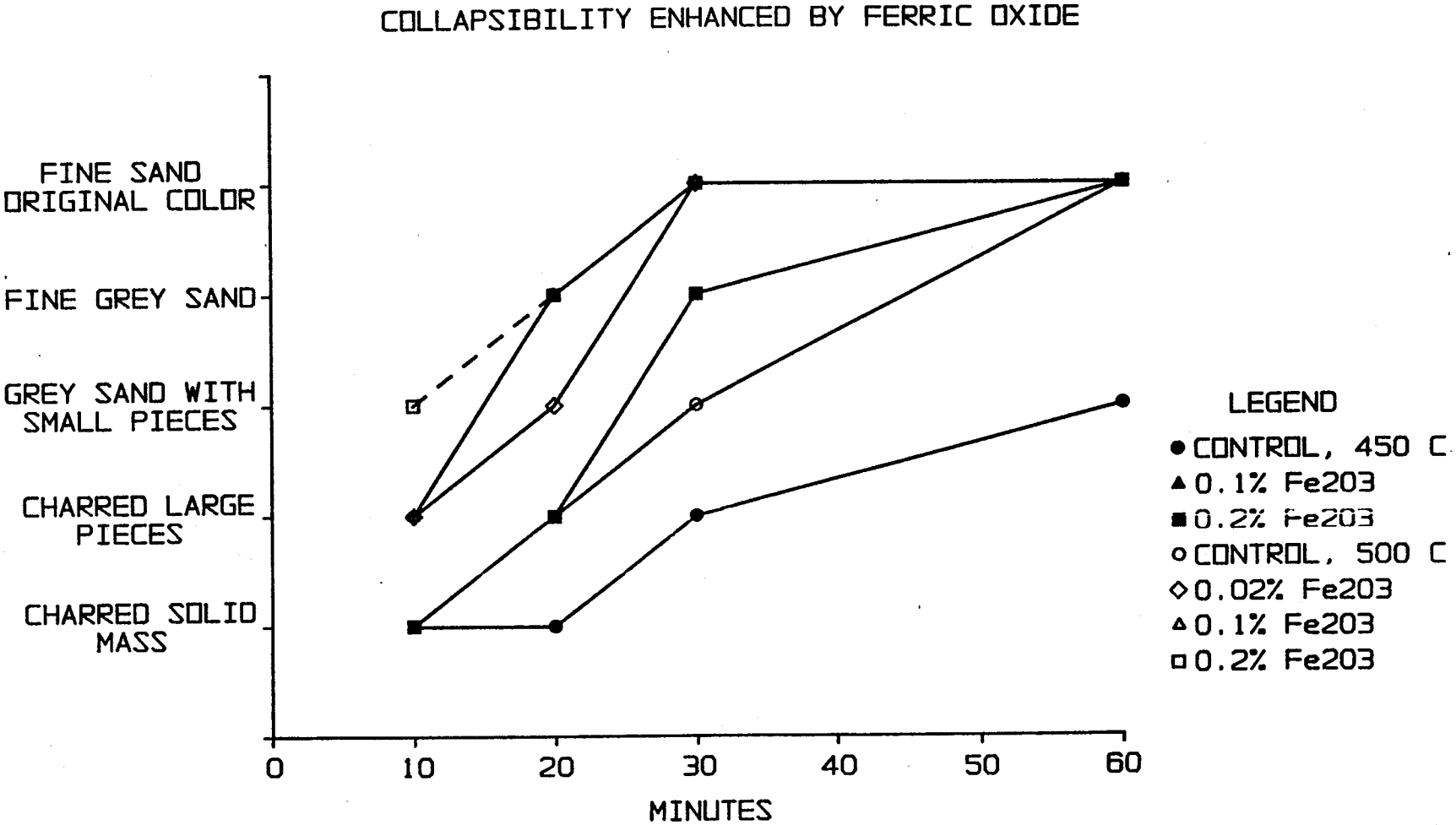
FIG. 1 shows the effect that the addition of ferric oxide has on the collapsibility of a sand core held together with the gelatin-based binder formulated in accordance with this invention.

A method is provided for forming a sand core which is suitable for use in a casting process, and in particular a squeeze casting process, so as to form internal features and intricate external features of a cast article. The core forming method involves the use of a single-component binder which serves to simplify the process by which the core is formed, mixed with a metal compound to promote degradation of the binder. The gelatin-based binder is also water soluble such that it can be easily eliminated from the core sand at the end of the casting process. In addition, the binder readily degrades at relatively low casting temperatures, such as those associated with aluminum casting processes, such that the core degrades sufficiently to permit the sand to flow freely from the casting without the need for additional core removal operations. Finally, the binder is nontoxic, such that its elimination from the sand, to reclaim the sand for reuse, does not pose an environmental hazard.

Conventionally, cores used in casting processes are formed as green-sand cores or dry-sand cores, the difference being that green-sand cores are made from standard molding-sand mixtures, such as a mixture of silica sand and clay or bentonite, while dry-sand cores are made from silica sand and a binder which hardens when subjected to heat. The present invention pertains to dry-sand cores, which are much less fragile than green-sand cores. While silica sand is the conventional particulate material used to make these types of cores, the use of other materials as substitutes for sand is foreseeable and within the scope of this invention.

The preferred binder of the present invention is a gelatin, or a gelatin-like equivalent, which is a water-soluble, organic binder made from a mixture of proteins, i.e., polymers of amino acids, such as glycine, L-proline, L-alanine, L-glutamic acid, and L-aspartic acid. The preferred binder composition is commercially available as food grade gelatin, generally having the following preferred composition, in weight percent: about 25 percent glycine, about 18 percent proline, about 14 percent hydroxyproline, about 11 percent glutamic acid, about 8 percent alanine, about 8 percent arginine, about 6 percent aspartic acid, about 4 percent lysine, about 3.2 percent leucine, about 2.5 percent valine and about 1.4 percent isoleucine, with the balance generally being other known amino acids. As will be apparent to those skilled in the art, the ratio of these components may be varied to adjust the physical characteristics of the core, such as the brittleness to toughness ratio, and the curing time and temperature of the core. As polypeptide proteins, the above constituents are colloidal by nature in the presence of water.

As a colloidal binder, the preferred formulation of the binder can be described in terms of a Bloom number, which is an arbitrary scale used for rating the strength of gelatin gels. Basically, in terms of the binder of this invention, higher Bloom numbers indicate a higher average molecular weight of the polypeptides (which are the polymers of the amino acids), though Bloom numbers are assigned by evaluating the viscosity of a colloid and not its molecular weight per se. In terms of a Bloom number, the preferred binder formulation of this invention contains about 65 to about 100 weight percent Bloom 175 colloids, up to about 10 weight percent Bloom 225 colloids, and up to about 10 weight percent Bloom 300 colloids. As a binder, the higher Bloom numbers create a harder, more brittle core. Therefore, when desirable, the hardness and brittleness of the core may be altered by adjusting the amount of higher Bloom number constituents within the binder. In addition, the preferred binder formulation contains up to about 5 weight percent gum arabic and up to about 10 weight percent of a sugar, such as sucrose, which serve to promote crystalline strength and durability of the final dried core.

Importantly, cores made in accordance with this invention include the addition of a ferric compound in quantities of less than about 1 weight percent. More preferably, the ferric compound is ferric oxide ($Fe_2O_3$) in amounts from about 0.02 to about 0.2 weight percent, or ferric phosphate ($FePO_4.H_2O$) or ferric pyrophosphate ($Fe_4(P_2O_7)_3.xH_2O$) in amounts up to about 0.5 weight percent. The ferric compound is preferably added as a fine powder with a particle size of about one micron. The addition of the ferric compounds is for the purpose of enhancing the thermal breakdown of the binder when surrounded by the molten metal during the casting process. The iron within each compound serves to catalyze the oxidative breakdown of the binder and therefore tends to make pour-out of the sand easier after the metal cools.

An example of the effectiveness of the use of ferric oxide in combination with the organic binder of this invention is illustrated in FIG. 1. The graph illustrates the progressive breakdown of the core base material from "Charred solid mass" to "Fine sand original color", when it is held in a simulated aluminum casting at 450° C. (a realistic post-casting core temperature) for the times shown on the abscissa. The organic binder material itself fails to completely breakdown after one hour at 450° C. (solid bullets) and requires one hour to breakdown at 500° C. (hollow bullets). The addition of about 0.1 and about 0.2 weight percent ferric oxide accelerates the decomposition of the binder at 450° C., such that the core is degraded to a quantity of loose grey sand with only small pieces of under-decomposed binder after only 10 minutes. After 20 minutes, all of the core is characterized by loose fine grey sand which will pour easily from the casting, and after 30 minutes the binder has been completely oxidized and the sand has returned to its original color.

The gelatin binder of this invention is preferred over thermoplastic and thermosetting binders known in the prior art in that protein polymers are considerably less crosslinked than such plastic polymers. As a result, significantly lower amounts of heat are required to break the bonds of the protein structure and thermally degrade the binder, permitting the sand to move individually and freely from the cast article. This aspect makes the binder of this invention particularly adapted for use with low melting point metals, such as aluminum, though it would be expected to work well when casting iron and other higher temperature metals.

Amino acid polymers are also preferred over thermoplastic and thermosetting polymers because, as a colloid, protein polymers are crystalline when dehydrated and have a high crystalline strength, even when heated. As a result, they possess good hot strength and do not tend to yield plastically under high heat and pressure. This aspect is particularly advantageous when the desired casting method is a squeeze casting process, which entails subjecting the molten metal within the mold cavity to high pressures. Such methods are particularly suited for the casting of fine-grain aluminum articles which must exhibit high strength, such as cast aluminum alloy engine blocks for the automotive industry.

In accordance with this invention, the preferred core forming process includes mixing silica or zirconium sand with the preferred gelatin-based binder, wherein the gelatin is preferably provided in a dry powder form. Water is then added to the dry sand-gelatin mixture so as to suspend the gelatin in the water such that the gelatin becomes colloidal. Alternatively, the gelatin can be pre-dissolved in an amount of water, such as a solution containing the preferred binder and up to about ⅔ water by weight. This solution can then be mixed with the sand, after which the water content can be adjusted to attain a preferred level for forming the core. In that the ferric compound is water insoluble, it can be added at any convenient time, such as being mixed in with the sand or mixed in with the preferred gelatin prior to being added to the sand.

In any event, the preferred final range of constituents within the mixture is about 0.5 to about 3 weight percent of the preferred gelatin, up to about 4 weight percent water and up to about 1 weight percent of the ferric compound, with the balance being silica sand. A more preferred formulation is about 0.75 weight percent gelatin, from about 2.5 to about 3 weight percent water, and ferric oxide in amounts from about 0.02 to about 0.2 weight percent or ferric phosphate or ferric pyrophosphate in amounts of up to about 0.5 weight percent, with the balance being silica sand. A water content of above about 4 weight percent is undesirable in that the subsequent dehydration process required to form the desired rigid core shape may be overly expensive or impractical. The quantity of the preferred binder employed may vary within the above range, depending in part on the type of sand used.

Figure 2:
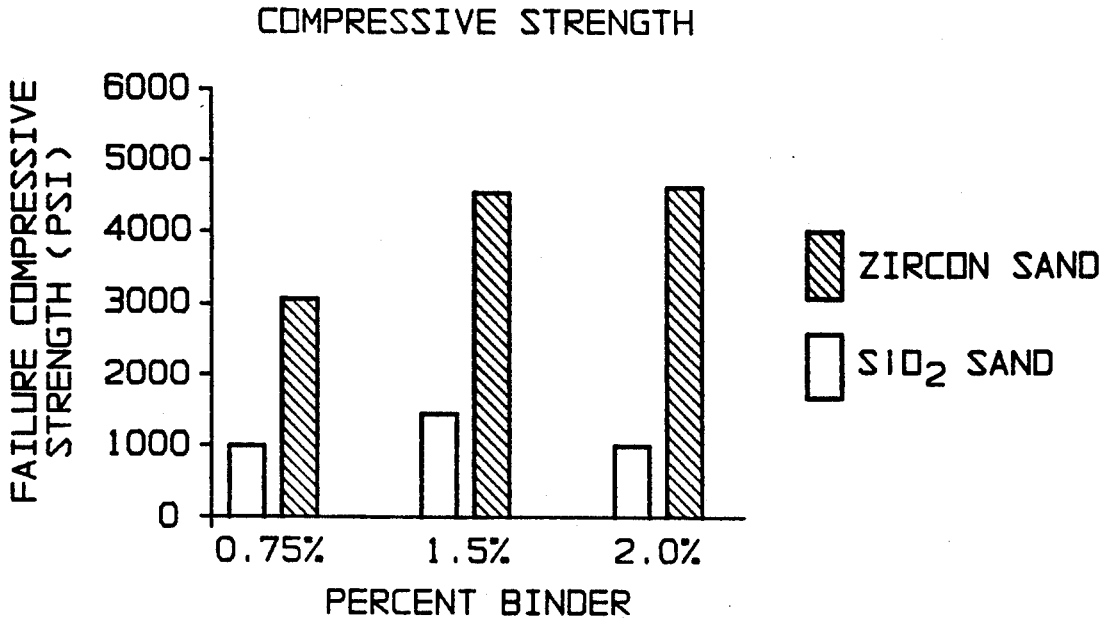
FIG. 2 shows the relative compressive strengths of sand cores held together with varying quantities of the gelatin-based binder.
Figure 3:
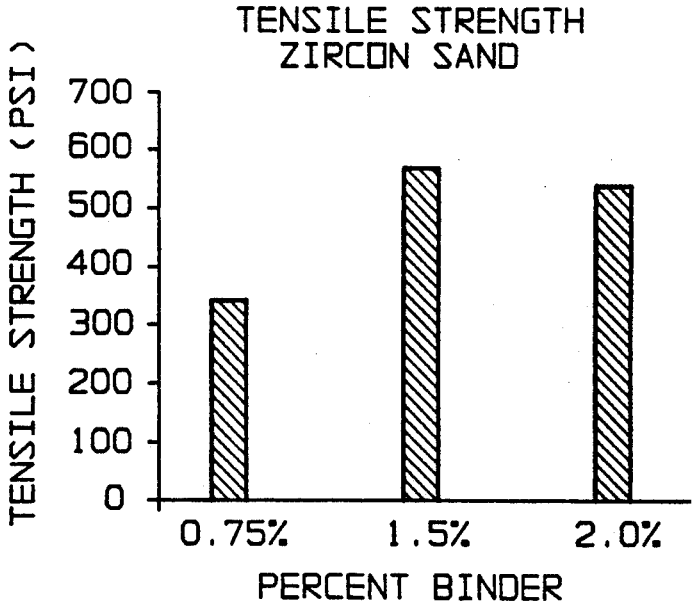
FIG. 3 shows the relative tensile strengths of sand cores held together with varying quantities of the gelatin-based binder.

FIGS. 2 and 3 illustrate the effect that binder content has on the mechanical strength of test cores made from zircon and silica sand for compressive strength and for tensile strength using zircon sand. In each case, increasing the amount of gelatin binder used beyond the recommended range does not result in further increases in core strength.

The preferred mixture will generally have the consistency of a slurry. This slurry may be preheated to a temperature of about 60° C. to about 70° C. prior to introducing the slurry into the core mold cavity so as to facilitate the filling of the cavity. Otherwise, the slurry may be introduced into the cavity at room temperature. The mold may also be preheated or heated after the slurry has been injected into the cavity. Once in the cavity, the slurry is preferably packed tightly by either applying air pressure or through the use of a mechanical press to bring the sand grains into close proximity with each other so as to increase the strength of the final core by eliminating voids between individual sand particles.

After compaction, the mold and slurry are heated to a cure temperature of about 70° C. to about 80° C., and more preferably to about 70° C., by any known means, such as infrared irradiation, radio frequency induction or microwave irradiation. The preferred duration for which the slurry is held at the cure temperature is from about 2 to about 5 minutes, which is sufficient to consolidate the sand and gelatin to form the core. The mold and mixture may then be allowed to cool to room temperature.

However, while the core is still at an elevated temperature after curing, such as about 70° C. to about 80° C., it is preferably that a vacuum be applied to remove the residual water from the core. A vacuum of at least about 101 Pascals (Pa), and more preferably from about 96.5 Pa to about 101 Pa, for a duration of about 5 to about 10 minutes is generally sufficient for this purpose. This dehydration step is critical in that any residual moisture within the core will weaken the water-soluble gelatin binder and cause erosion of the sand, such that the surface quality of the core will be adversely effected. Therefore, it is preferable that this dehydration step be performed before the mold and mixture are cooled to room temperature and after curing so as to maximize the integrity of the core. However, this step may not be necessary under some circumstances. After dehydration, the core is cooled to room temperature and released from the core mold cavity. The core is at this time ready for use in a casting operation.

The core may be further treated if desirable or necessary. For example, the core may be coated with a refractory material to improve its performance, as is known to those skilled in the art. In addition, so as to prevent atmospheric humidity from degrading the core, the core may be coated with a non-water soluble and preferably biodegradable polymer such as poly(β-hydroxyalkynoates) or chitosan, as well as others, to improve the core's shelf life.

Conventionally, the use of a sand core in a casting process includes placing the core within a mold cavity to form interior surfaces and/or intricate exterior surfaces of the casting. A molten material, such as iron or an aluminum alloy, is then introduced into the mold cavity. If a squeeze casting process is involved, the mold halves are mechanically pressed together typically by a hydraulic press during the molding operation.

This action imposes physical loads on the cores, in addition to the elevated temperatures which will begin to degrade the core. However, it is a particular feature of this invention that the core made by the above process possesses sufficient hot strength such that it is capable of withstanding the pressures imposed by a squeeze casting operation.

Also according to this invention, the melting temperature of the molten material is sufficient to degrade the preferred gelatin binder such that the sand will flow freely from the casting after the molten material has cooled. The preferred gelatin binder of this invention begins to thermally degrade due to oxidation at about 450° C. In particular, the gelatin binder readily degrades during casting, due to the presence of the molten aluminum which has a relatively low melting temperature of about 675° C. or lower.

Once removed from the casting, the sand may be cleaned by flowing clean water through it to remove the residual polymer proteins. Because the gelatin binder is organic, nontoxic and biodegradable, the cleaning water does not pose an environmental hazard but is enriched by the polymer proteins removed from the sand. Ideally, this water can be used within a foundry operation as feedstock or broth for the foundry wastewater treatment plant. This broth will fortify the bacterial colony that is resident in the treatment plant and guard against die-off of the bacteria due to toxic or environmental insults which are often introduced during normal foundry operation.

From the above, it can be seen that an advantageous feature of the present invention is that the gelatin binder is able to adhere the core sand together such that the core is characterized by a closely-packed particulate structure having sufficient hot strength to perform well in a squeeze casting operation. Because the gelatin binder is colloidal, the protein polymers are crystalline when dried. As a result, they do not tend to yield plastically under high heat and pressure, as do thermoplastic and thermosetting polymers typically used for such purposes.

The use of the gelatin-based binder of this invention is also advantageous in that, as a result of the presence of the ferric compound, the gelatin-based binder readily degrades when subjected to casting temperatures as low as those associated with aluminum casting, i.e., 675° C. or lower. As a result, the core is readily broken down during the casting process such that the core sand flows freely from the casting. This is contrary to results obtained with conventional thermoplastic and thermosetting polymer binders, which do not sufficiently break down when exposed to aluminum casting temperatures, making the core very difficult or impossible to remove from the cast article.

The preferred gelatin binder of this invention is also water soluble, nonflammable and nontoxic, such that the preferred gelatin binder can be easily and safely washed from the core sand with water without the binder residue posing an environmental hazard. The water solubility of the preferred gelatin binder is a particularly advantageous feature in that it permits the core to be washed from the casting even if the gelatin binder has not completely broken down from the heat of the casting process. This feature also enables the core sand to be readily recycled for use in a later casting operation or returned to the environment without posing an adverse environmental impact.

Therefore, while our invention has been described in terms of a preferred embodiment, it is apparent that other forms could be adopted by one skilled in the art, for example, by modifying the processing parameters such as the temperatures or durations employed, or by substituting appropriate particulate materials for the silica sand, or by utilizing the gelatin-based binder system in alternative casting and forming operations. Accordingly, the scope of our invention is to be limited only by the following claims.

The embodiments of the invention in which an exclusive property or privilege is claimed are defined as follows:

1. A method for forming a core used in a casting process, the method comprising the steps of:

mixing a particulate material with a ferric compound and a water-soluble gelatin binder comprising one or more proteins, such that the particulate material, the ferric compound and the gelatin binder form a mixture, the ferric compound being selected from the group consisting of ferric oxide, ferric phosphate and ferric pyrophosphate;

adding water to the mixture to form a gelatin binder colloid;

forming the core from the mixture; and heating the core at a temperature and for a duration which is sufficient to cure the gelatin binder colloid;

whereby the gelatin binder colloid adheres the particulate material together such that the core is characterized by a closely-packed particulate structure having structural strength, and wherein the ferric compound promotes thermal degradation of the gelatin binder colloid such that the core can be readily broken down by the heat associated with the casting process.

2. A method for forming a core as recited in claim 1 wherein the proteins comprise glycine, alanine, valine, leucine, isoleucine, proline, hydroxyproline, aspartic acid, glutamic acid, arginine and lysine.

3. A method for forming a core as recited in claim 1 wherein at least a portion of the proteins have a Bloom number of 175.

4. A method for forming a core as recited in claim 1 further comprising the step of removing moisture from the core under vacuum after the heating step.

5. A method for forming a core as recited in claim 1 wherein the core is heated to a temperature of about 70° C. to about 80° C. during the heating step.

6. A method for forming a core as recited in claim 1 wherein the proteins comprise:

about 65 to about 100 weight percent of colloidal particles having a Bloom number of 175;

up to about 10 weight percent of colloidal particles having a Bloom number of 225;

up to about 10 weight percent of colloidal particles having a Bloom number of 300.

7. A method for forming a core as recited in claim 1 wherein the gelatin binder further comprises up to about 5 weight percent gum arabic and up to about 10 weight percent sugar.

8. A method for forming a core as recited in claim 1 further comprising the step of coating the core with a non-water soluble coating.

9. A method for forming an aluminum casting which includes the use of a core during a casting process, the method comprising the steps of:

forming the core from a mixture of a solvent, a particulate material, a ferric compound, and a water-soluble gelatin binder comprising one or more proteins, wherein the ferric compound is selected from the group consisting of ferric oxide, ferric phosphate and ferric pyrophosphate, the mixture being heated at a temperature and for a duration which is sufficient to cure the gelatin binder such that the gelatin binder adheres the particulate material together;

placing the core within a mold cavity; and introducing molten aluminum into the mold cavity at a temperature which is sufficient to degrade the gelatin binder such that the particulate material flows freely from the aluminum casting formed from the molten aluminum during the casting process.

10. A method for forming an aluminum casting as recited in claim 9 further comprising the step of removing the gelatin binder from the particulate material by dissolving the gelatin binder in water.

11. A method for forming an aluminum casting as recited in claim 9 wherein the proteins comprise glycine, alanine, valine, leucine, isoleucine, proline, hydroxyproline, aspartic acid, glutamic acid, arginine and lysine.

12. A method for forming an aluminum casting as recited in claim 9 wherein the proteins comprise:

about 65 to about 100 weight percent of colloidal particles having a Bloom number of 175;

up to about 10 weight percent of colloidal particles having a Bloom number of 225;

up to about 10 weight percent of colloidal particles having a Bloom number of 300; and wherein the gelatin binder further comprises:

up to about 5 weight percent gum arabic; and up to about 10 weight percent sugar.

13. A method for forming an aluminum casting as recited in claim 9 further comprising the step of coating the core with a non-water soluble coating after the forming step.

14. A core for use in a metal casting process, the core comprising a mixture of a particulate material, a ferric compound selected from the group consisting of ferric oxide, ferric phosphate and ferric pyrophosphate, and a water-soluble gelatin binder comprising one or more proteins;

whereby the core is characterized by a closely-packed particulate structure having structural strength, and wherein the ferric compound promotes thermal degradation of the gelatin binder such that the core readily disintegrates at temperatures associated with the metal casting process, so as to enable the particulate material to flow freely from a metal casting formed by the metal casting process.

15. A core as recited in claim 14 wherein the proteins comprise glycine, alanine, valine, leucine, isoleucine, proline, hydroxyproline, aspartic acid, glutamic acid, arginine and lysine.

16. A core as recited in claim 14 wherein at least a portion of the proteins have a Bloom number of 175.

17. A core as recited in claim 14 wherein the proteins comprise:

about 65 to about 100 weight percent of colloidal particles having a Bloom number of 175;

up to about 10 weight percent of colloidal particles having a Bloom number of 225;

up to about 10 weight percent of colloidal particles having a Bloom number of 300.

18. A core as recited in claim 14 wherein the gelatin binder further comprises up to about 5 weight percent gum arabic and up to about 10 weight percent sugar.

19. A core as recited in claim 14 further comprising a non-water soluble coating applied to the exterior surfaces of the core.

* * * * *